US005481969A

United States Patent [19]

Beck et al.

[11] Patent Number: 5,481,969

[45] Date of Patent: Jan. 9, 1996

[54] APPARATUS FOR THE IN-REGISTER POSITIONING OF A CUTTING PLATE ON A CUTTING CYLINDER, PREFERABLY IN ROTARY PRINTING MACHINES

[75] Inventors: Heinrich Beck, Weisenheim a. Sand; Heinz Dobriwolski, Rudesheim-Aulhausen, both of Germany

[73] Assignee: MAN Roland Druckmaschinen AG, Germany

[21] Appl. No.: 324,875

[22] Filed: Oct. 18, 1994

[30] Foreign Application Priority Data

Oct. 23, 1993 [DE] Germany ..... 9316230 U

[51] Int. Cl.[6] ..... B41F 27/00

[52] U.S. Cl. ..... 101/389.1; 101/DIG. 36; 33/621

[58] Field of Search ..... 101/378, 382.1, 101/383, 415.1, 485, 486, DIG. 36, 389.1; 33/614, 615, 616, 617, 621

[56] References Cited

U.S. PATENT DOCUMENTS

| | | | |
|---|---|---|---|
| 2,907,274 | 10/1959 | Taylor | 101/DIG. 36 |
| 4,383,760 | 5/1983 | Deter et al. | 101/DIG. 36 |
| 4,446,625 | 5/1984 | Hagan et al. | 101/DIG. 36 |
| 4,705,590 | 11/1987 | Vandenberg | 101/415.1 |
| 5,320,041 | 6/1994 | Maejima et al. | 33/621 |

FOREIGN PATENT DOCUMENTS

| | | |
|---|---|---|
| 2341326C3 | 7/1977 | Germany . |
| 277050A1 | 3/1990 | Germany . |
| 4138276A1 | 5/1993 | Germany . |

OTHER PUBLICATIONS

Kocher & Beck GmbH & Co. brochure hpb/10–80/3.d/rt–ra.

*Primary Examiner*—Ren Yan
*Attorney, Agent, or Firm*—Leydig, Voit & Mayer, Ltd.

[57] ABSTRACT

Apparatus for assuring the in-register positioning of a cutting plate on a cutting cylinder, preferably a magnetic cylinder in a rotary printing machine. The apparatus comprises a contact plate which is arranged tangentially to the cutting cylinder. The contact plate is formed with a slot running axially parallel to the cylinder for the purpose of receiving the cutting plate, the slot having an edge which serves as a stop. An axially parallel measuring bar is positioned along the cylinder length and is parallel to the contact plate. Extending around the circumference of the cutting cylinder is a second measuring bar which crosses the first measuring bar.

6 Claims, 2 Drawing Sheets

APPARATUS FOR THE IN-REGISTER POSITIONING OF A CUTTING PLATE ON A CUTTING CYLINDER, PREFERABLY IN ROTARY PRINTING MACHINES

BACKGROUND OF THE INVENTION

The invention relates to apparatus for the inregister positioning of a cutting plate on a cutting cylinder, preferably a magnetic cylinder in a rotary printing machine.

More specifically, the apparatus provides exact alignment of the cutting plate, also called a punching plate, on the cylinder.

The mounting of cutting or punching plates on cutting or punching cylinders has been achieved by tensioning means as disclosed, for example, in DE 4,138,278 A1, or by means of bonding as disclosed in DE 2,341,326 C3.

It is also known to use magnetic techniques in a rotary punch construction. In such an instance, the cutting cylinder is designed as a magnetic cylinder which has a multiplicity of powerful magnets (e.g., permanent magnets) distributed over its circumference. A ferromagnetic, formable cutting plate is placed on the magnetic cylinder and is held by magnetic force. The cutting plate has an appropriate cutting edge geometry in order preferably to punch out labels. Magnetic cylinders of this type are disclosed, for example, by the company brochure hpb/10-89/3.d/rt-ra of Kocher & Beck GmbH & Co. Rotationsstanztechnik KG, D-72124 Pliezhausen, Germany.

It is disadvantageous in the latter case that the magnetic cylinders do not permit rapid and exact (and thus in-register) positioning of the cutting plates as a result of the strong magnetic forces of the cylinders. The cutting plate can only be positioned in register with great difficulty since, when the cutting plate is mounted on the magnetic cylinder, the cutting plate is attracted forcefully and in an uncontrollable manner toward the cylinder by the magnetic forces. However, in-register positioning is absolutely essential, for example, when copies have to be perforated, such as in the case of postage stamps.

SUMMARY OF THE INVENTION

The general object of the invention is to provide apparatus which appreciably reduces these disadvantages.

More specifically, the invention permits exact, in-register positioning of a cutting plate on a cutting cylinder, preferably a magnetic cylinder. By means of the invention, the cutting plate is prevented from being attracted by the magnetic cylinder in an uncontrollable manner as a result of the magnetic forces when the cutting plate is being placed on the cylinder. The apparatus according to the invention permits the rapid exchange of cutting plates on the magnetic cutting cylinder. In the case of relatively short runs and frequent order changes, the conversion times are reduced considerably. The apparatus is suitable for single-size or multiple-size cutting cylinders and can be used irrespective of the blade contour located on the cutting plate.

These and other objects and advantages of the invention will become more apparent from the following detailed description when taken in conjunction with the accompanying drawings.

Figure 1:
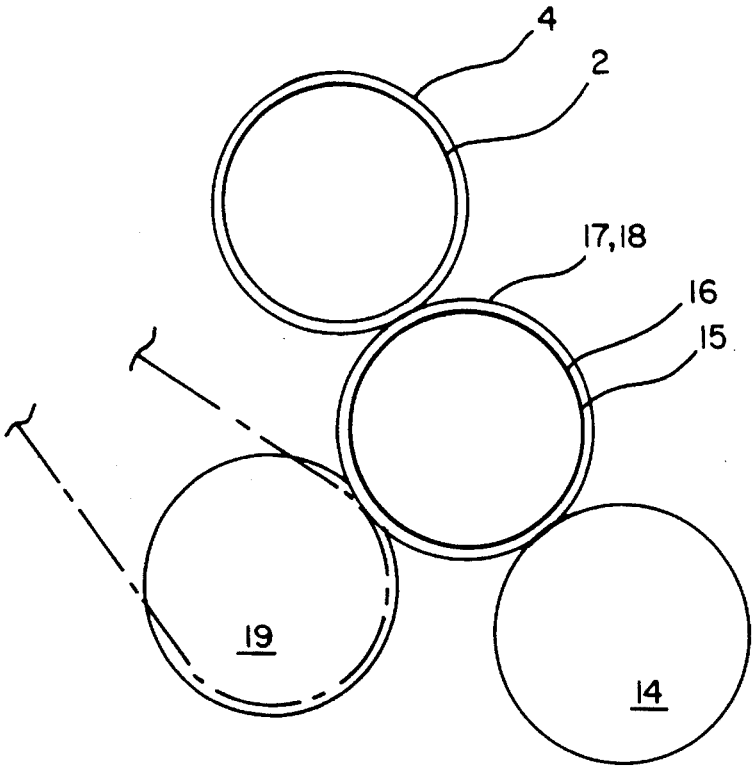
FIG. 1 is a schematic view showing the basic construction of the cutting apparatus.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

In an offset sheet printing machine, a cutting device is arranged downstream of the last printing unit and serves for the in-line perforation of printing carriers (e.g., a sheet of postage stamps). Arranged upstream of the cutting device is a sheet conveying drum 14 disposed in contact with a counter cylinder 15 which acts as an anvil cylinder. Arranged on the counter cylinder 15 is a dressing of steel plate 17, which receives a sheet 18, with an aligning sheet 16 located below it. Assigned to the counter cylinder 15 is a cutting cylinder 2 which is designed as a magnetic cylinder. A cutting plate 4 is arranged as a punching plate in a cutting zone 6 on the cutting cylinder 2. The cutting plate 4 is in contact with the sheet 18.

Figure 3:
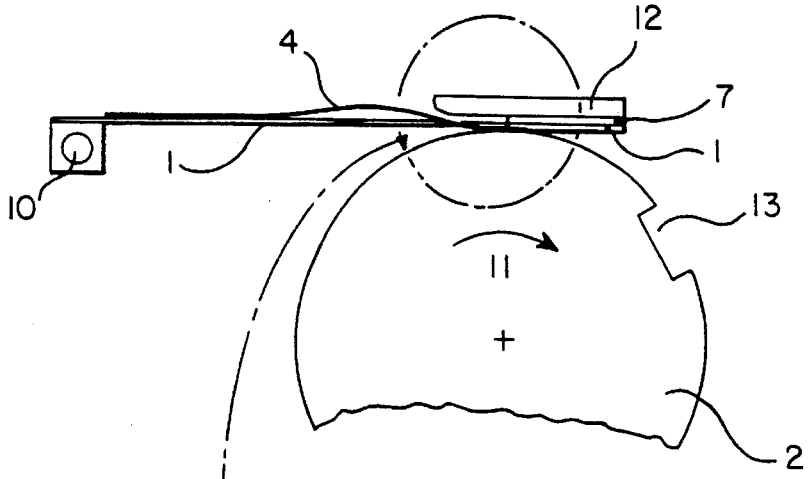
FIG. 3 shows a positioning apparatus.
Figure 4:
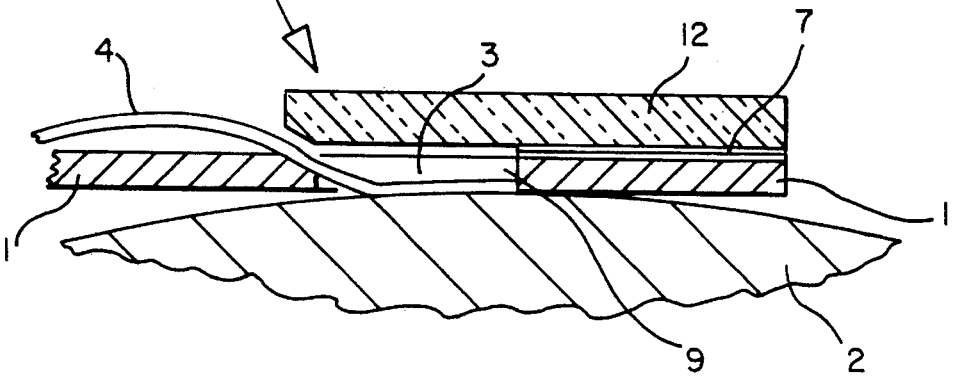
FIG. 4 is an enlarged view of certain components shown in FIG. 3.

Arranged downstream of the counter cylinder 15 is a delivery system 19 which receives the sheet 18 and places it on a pile (not described in detail). Associated with the cutting cylinder 2 is a contact plate 1 (FIGS. 3 and 4) which is received so as to be rotatable in bearings 10. The contact plate 1 has a slot 3 which extends over the length of the cylinder and is slightly longer than the ferromagnetic cutting plate 4 to be placed on the cylinder. The contact plate 1 has a covering 12 which preferably consists of a transparent material and serves, at the same time, as a guard in the case of the cylinder gap 13 possibly running through. The contact plate 1 forms a leading edge 9 on the slot 3 in the direction of rotation 11, the leading edge serving as a stop for the cutting plate 4. A measuring bar 7 is arranged on the contact plate 1 parallel to the axis of the cutting cylinder 2 and extends along the entire length of the cylinder. In the circumferential direction of the cutting cylinder 2, a measuring bar 5 is arranged on the cylinder in the region of bearing rings 8, but outside the cutting zone 6. The circumferentially extending measuring bar 5 and the axially extending measuring bar 7 cross one another.

The functioning of the apparatus is as follows: If the cutting plate 4 is to be positioned on the cutting cylinder 2, the contact plate 1, held in the bearings 10 on the side frames (not shown), is pivoted clockwise out of its parked position and in the direction of the cutting cylinder 2 in such a way that it bears tangentially against the circumference of the cutting cylinder. The cutting cylinder 2 is moved in the direction of rotation 11 below the contact plate 1 until the leading edge 9 of the measuring bar 7 is in alignment with a measurement on the measuring bar 5 at which the cutting plate is to begin. The cutting plate is then moved into the slot 3 of the contact plate 1 and strikes the leading edge 9 of the contact plate 1. The contact plate 1 can be raised slightly from the cutting cylinder 2 in order to expose the cutting plate 4, but it remains in its bearings 10. The cutting cylinder 2 is moved in the direction of rotation and the cutting plate 4 is wrapped around the cutting cylinder. The slot 3 is constructed with a narrow circumferential dimension in such a way that the cutting plate 4 bears against the circumference of the cutting cylinder 2 only along such dimension, but is sufficiently fixed to the cylinder. Since the magnetic forces as holding forces are still small in this circumferentially narrow region, the cutting plate 4 can easily be positioned manually to be in register. If the measuring bar 5 is adjusted on the circumference in such a way that a zero point coincides with the leading edge of the sheet 18, a precise reference (grid) is obtained.

Figure 2:
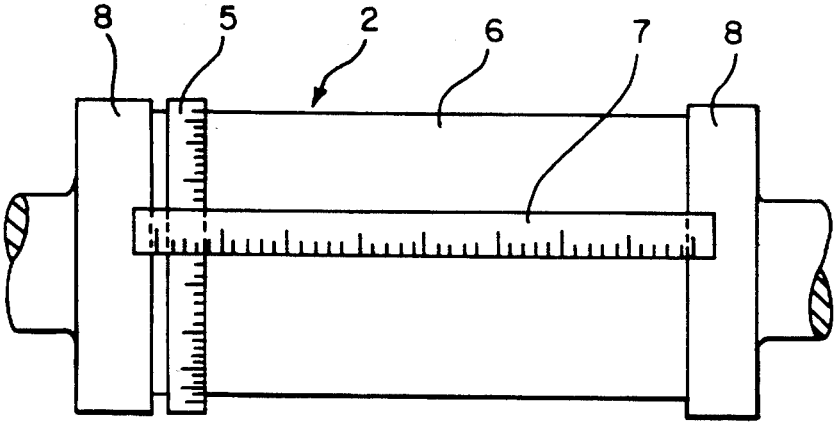
FIG. 2 shows a cutting cylinder with measuring bars.
Figure 5:
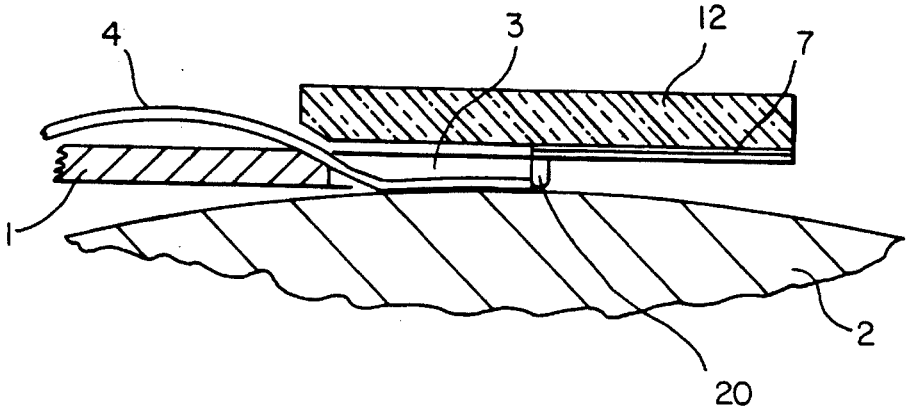
FIG. 5 is an enlarged view, similar to FIG 4, showing an alternative embodiment.

For better understanding, the contact plate is not illustrated in FIG. 2. In a further design, the leading edge 9 can, for example, also be formed by two registering pins 20, as shown in FIG. 5. These registering pins 20 are constructed so that they can electrically, detect and signal whether the cutting plate 4 is positioned correctly.

We claim:

1. Apparatus for the in-register positioning of a cutting plate on a cutting cylinder, said apparatus comprising a contact plate extending substantially tangentially of the cylinder, said contact plate having a slot extending generally parallel to the axis of the cylinder, said slot being adapted to receive said cutting plate and having means serving as a stop for said cutting plate, a first measuring bar extending substantially parallel to the axis of the cylinder and extending along substantially the entire length of the cylinder, and a second measuring bar extending circumferentially of the cylinder and crossing said first measuring bar.

2. Apparatus according to claim 1, characterized in that the cutting cylinder is a magnetic cylinder.

3. Apparatus according to claim 2, characterized in that the slot in the contact plate exposes a circumferentially narrow region of the cutting cylinder for positioning the cutting plate.

4. Apparatus according to claim 1 further including means mounting said contact plate for swinging away from the cutting cylinder.

5. Apparatus according to claim 1 further including a transparent cover, said first measuring bar being sandwiched between said cover and said contact plate.

6. Apparatus according to claim 1, characterized in that said means comprise registering pins.

* * * * *